US006758435B2

(12) United States Patent
Niemeyer et al.

(10) Patent No.: US 6,758,435 B2
(45) Date of Patent: Jul. 6, 2004

(54) GUIDE ASSEMBLY FOR A MISSILE

(75) Inventors: Torsten Niemeyer, Celle (DE); Manfred Dieter Schwies, Hermannsburg (DE); Uwe Naderhoff, Hermannsburg (DE); Thomas Heitman, Unterlüss (DE); Michael Imdahl, Hermannsburg (DE); Rudolf Rombach, Mönchbengladbach (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 10/226,241

(22) Filed: Aug. 23, 2002

(65) Prior Publication Data

US 2003/0038212 A1 Feb. 27, 2003

Related U.S. Application Data

(63) Continuation-in-part of application No. 09/733,071, filed on Dec. 11, 2000, now abandoned.

(30) Foreign Application Priority Data

Dec. 9, 1999 (DE) ..... 199 59 357

(51) Int. Cl.[7] ..... F42B 10/14

(52) U.S. Cl. ..... 244/3.28; 244/3.24; 244/49; 244/87

(58) Field of Search ..... 244/3.24–3.3, 244/44, 46, 87

(56) References Cited

U.S. PATENT DOCUMENTS

| | | | | | |
|---|---|---|---|---|---|
| 2,405,415 | A | * | 8/1946 | Eksergian | 244/3.28 |
| 2,427,217 | A | * | 9/1947 | Lebhertz et al. | 244/3.28 |
| 3,790,104 | A | | 2/1974 | Jones | |
| 4,534,294 | A | * | 8/1985 | Von Laar et al. | 244/3.28 |
| 4,641,802 | A | | 2/1987 | Zalmon et al. | |
| 4,693,434 | A | | 9/1987 | Schwenzer et al. | |
| H905 | H | | 4/1991 | Rottenberg | |
| 6,314,886 | B1 | * | 11/2001 | Kuhnle et al. | 244/3.28 |

FOREIGN PATENT DOCUMENTS

FR 2 070 389 A 9/1971

* cited by examiner

*Primary Examiner*—Galen Barefoot
(74) *Attorney, Agent, or Firm*—Venable LLP; Stuart I. Smith

(57) ABSTRACT

A missile includes a missile body and a guide assembly mounted on the missile body. The guide assembly has a plurality of pivots and a plurality of vanes mounted on respective pivots for a swinging motion between a folded position of rest and a deployed flight position. The vanes are arranged for free pivotal motion during flight in response to forces acting thereon to determine the flight position. In the folded position of each vane, its center of gravity is situated at a greater distance from the longitudinal axis of the missile body than the pivotal axis of the respective vanes. Abutments limit the flight position of the vanes to a maximum angle between the length dimension of the vanes and the longitudinal axis of the missile body. The maximum angle is greater than 90°.

4 Claims, 1 Drawing Sheet

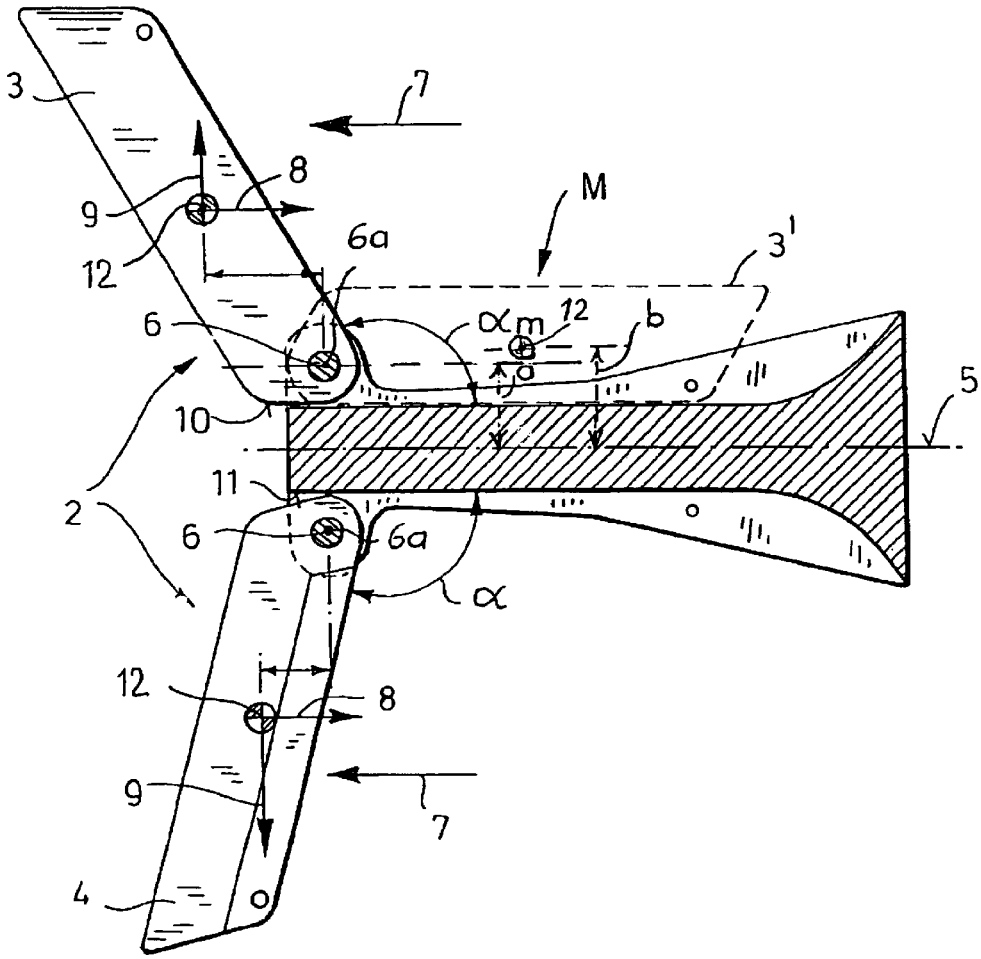
3
7
8
9
12
6a
M
3'
6
αm
12
b
a
5
10
11
2
6
6a
α
12
8
9
7
4

GUIDE ASSEMBLY FOR A MISSILE

CROSS REFERENCE TO RELATED APPLICATION

This application is a continuation in part of application Ser. No. 09/733,071 filed Dec. 11, 2000, now abandoned.

This application claims the priority of German Application No. 199 59 357.4 filed Dec. 9, 1999, which is incorporated herein by reference.

BACKGROUND OF THE INVENTION

This invention relates to a missile and particularly concerns a guide assembly therefor. The guide assembly includes vanes which have an inwardly pivoted, folded position of rest and an outwardly pivoted, deployed state which they assume in flight during which the missile rotates about its longitudinal axis.

Missiles which have foldable stabilizing guide assemblies and which, for example, by virtue of the position of the vanes, rotate about the longitudinal missile axis (compensating twist) during flight are well known. To obtain a defined position of the vanes along the entire flight path, in the known missiles the vanes are blocked (immobilized) by a locking device in their outwardly pivoted, deployed end position.

It is, among others, a disadvantage of the above-outlined guide assemblies that during flight the forces exerted on the vanes lead to varying mechanical stresses to which the vane locking mechanisms are exposed. Such changing mechanical stresses often result in jars and vibrations to the entire missile which, for example, when sound sensors are used, may lead to a defective operation of fuzes of high-explosive projectiles.

Further, in a known projectile fin assembly, as described in United States Statutory Invention Registration No. H905, the center of gravity of each vane (fin) is, in the folded state of the vane, situated inward of the pivotal axis of the vane; That is, the center of gravity of each vane is at a smaller distance from the longitudinal axis of the missile than the pivotal axis of the respective vane. Further, the maximum angle that the vanes may assume in their deployed end position is generally about 90°. It is a disadvantage of such a construction that, in flight, a state of equilibrium in the deployed position is not readily assumed and it may even occur that in some angular ranges the vanes pivot toward the folded position. Also, because of undefined angular magnitudes and undefined abutment positions, undesired impacting by the vanes may occur with disadvantageous effects, for example, on the fuze.

SUMMARY OF THE INVENTION

It is an object of the invention to provide an improved missile guide assembly of the above-outlined type whose vanes assume in the deployed state an aerodynamically favorable position without the forces exerted thereon (forces derived from air streams, centrifugal forces and mass inertia of the vanes) causing jars of the missile.

This object and others to become apparent as the specification progresses, are accomplished by the invention, according to which, briefly stated, the missile includes a missile body and a guide assembly mounted on the missile body. The guide assembly has a plurality of pivots and a plurality of vanes mounted on respective pivots for a swinging motion between a folded position of rest and a deployed flight position. The vanes are arranged for free pivotal motion during flight in response to forces acting thereon to determine the flight position. In the folded position of each vane, its center of gravity is situated at a greater distance from the longitudinal axis of the missile body than the pivotal axis of the respective vanes. Abutments limit the flight position of the vanes to a maximum angle defined between the length dimension of the vanes and the longitudinal axis of the missile body. The maximum angle is greater than 90°.

The invention is based essentially on the principle to provide a determined, but unblocked (that is, not locked or immobilized) deployed state of the vanes during flight, and to locate the center of gravity of each vane such that in the folded position of the vanes the center of gravity is farther away from the longitudinal missile axis than the pivotal axis of the vanes. Thus, the vanes, after the missile leaves the weapon tube, are pressed by the initially very high opposing air stream forces into a rearward end position defined by an abutment and subsequently, the vanes are pivoted forward into a frontal end position which is determined by an equilibrium of the forces affecting the vanes during flight. In the state of equilibrium the forces derived from the air stream push the vanes rearwardly while the mass inertia forces pull the vanes forwardly since the remainder of the missile is braked to a significantly greater extent than the vanes. In any event, the forces derived from the air streams are generally greater than the mass inertia forces, but as a rotation of the missile about its longitudinal axis starts, centrifugal forces generate a torque which also effects a forward pivotal motion of the vanes. Although the centrifugal force continuously increases during the flight of the missile, its axial component decreases as the vanes pivot forward. As a result, a torque equilibrium occurs where the angle $\alpha$ representing the angle between the length dimension of the vane and the longitudinal axis of the missile is generally greater than 90°.

The jars which may be caused by the impact of the vanes on their respective abutment do not lead to an unintended fuze activation because the fuze is armed only when the missile is at a certain distance from the firing device (muzzle area safety).

BRIEF DESCRIPTION OF THE DRAWING

The sole FIGURE is a fragmentary, partially sectional axial view of a missile illustrating a preferred embodiment of the invention.

DESCRIPTION OF THE PREFERRED EMBODIMENT

Turning to the FIGURE, a guide assembly 2 is mounted on the rearward end of a missile body 1 of a missile M. The guide assembly 2 has a plurality of vanes 3 and 4 whose forwardly oriented edges are conventionally sharpened for causing the missile body 1 to rotate about its longitudinal axis 5.

The vanes 3 and 4 are pivotal about an axis 6*a* of a pivot 6 from a folded position of rest (shown in dotted lines 3' for the vane 3) into an outwardly pivoted deployed flight position. For limiting the pivotal displacement caused by initially very substantial air stream forces, the vanes 3, 4 are, with respect to the respective pivot 6, in a laterally displaced position so that after they reach a maximum angular position $\alpha_m$ of, for example 120°, they abut with their underside 10 against a rearward region 11 of the missile body 1. Such a deployed flight position is shown in the Figure in solid lines for the vane 3. The maximum angular position is at least 90° and preferably is at least 120°.

The center of gravity 12 of each vane 3, 4 is disposed in such a manner in the folded position of the vanes that the distance b of the center of gravity 12 from the longitudinal missile axis 5 is greater than the distance a of the respective pivotal axis 6*a* from the axis 5. That is, in the folded position of the vanes 3, 4, the respective center of gravity 12 is farther away from the axis 5 than the respective pivotal axis 6*a*.

As the missile continues its flight, the vanes 3, 4 pivot forward into a frontal end position which results from an equilibrium of the forces to which the vane is exposed during flight. Thus, the force 7 derived from the air stream pushes the vanes 3 and 4 rearwardly whereas the force 8 derived from the mass inertia and the centrifugal force 9 urge the vanes 3 and 4 to pivot forwardly. The vane 4 is shown in the Figure in its aerodynamic position of equilibrium. The angular position $\alpha$ is, for example, 105°.

It is to be understood that the invention is not limited to the above-described embodiment. Thus, for example, the abutment which limits the vanes in their outwardly pivoted (deployed) flight position may be effected by separately provided abutment elements mounted on the rearward portion of the missile body 1. The maximum angular position the vanes assume in case of force equilibrium may be greater or lesser than 120°. In any event, the maximum angular position of the vanes $\alpha_m$ must be greater than the angular position $\alpha$ which the vanes assume in the state of force equilibrium.

It will be understood that the above description of the present invention is susceptible to various modifications, changes and adaptations, and the same are intended to be comprehended within the meaning and range of equivalents of the appended claims.

What is claimed is:

1. A missile comprising (a) a missile body having a longitudinal axis and (b) a guide assembly mounted on said missile body; said guide assembly including (1) a plurality of pivots;

(2) a plurality of vanes mounted on respective said pivots for a swinging motion about a pivotal axis between a folded position of rest and a deployed flight position; each said vane having a length dimension; said vanes being arranged for free pivotal motion during flight in response to forces acting thereon to determine said flight position; each said vane having a center of gravity that, in said folded position of each vane, is at a greater distance from said longitudinal axis than said pivotal axis of each vane; and (3) abutments limiting said flight position of said vanes to a maximum angle between said length dimension and said longitudinal axis; said maximum angle being greater than 90°.

wherein the abutments limit said maximum angle to an angle that is greater than positional angle of the vanes in a state of force equilibrium during flight.

2. The missile as defined in claim 1, wherein said abutments limit said maximum angle to 120°.

3. The missile as defined in claim 1, wherein said abutments limit said maximum angle to at least 120°.

4. The missile as claimed in claim 1, wherein, in use, after the vanes pivot to the maximum angle, the vanes pivot to the positional angle as a result of the force equilibrium.

* * * * *